US006516874B2

(12) United States Patent
Mathur et al.

(10) Patent No.: US 6,516,874 B2
(45) Date of Patent: Feb. 11, 2003

(54) ALL WELDED PLATE HEAT EXCHANGER

(75) Inventors: Achint P. Mathur, Wichita Falls, TX (US); Chuanbao Gu, Wichita Falls, TX (US); Jason Michael Fulmer, Wichita Falls, TX (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/005,949

(22) Filed: Dec. 5, 2001

(65) Prior Publication Data

US 2003/0000687 A1 Jan. 2, 2003

Related U.S. Application Data

(60) Provisional application No. 60/302,219, filed on Jun. 29, 2001.

(51) Int. Cl.[7] ..... F28F 3/00

(52) U.S. Cl. ..... 165/166; 165/170; 165/167

(58) Field of Search ..... 165/166, 167, 165/146, 170

(56) References Cited

U.S. PATENT DOCUMENTS 3,473,604 A * 10/1969 Tiefenbacher ..... 165/166
3,613,782 A * 10/1971 Mason ..... 165/166
3,759,323 A * 9/1973 Dawson et al. ..... 165/166
3,992,168 A * 11/1976 Toyama et al. ..... 165/166
4,183,403 A * 1/1980 Nicholson ..... 165/166
4,688,631 A 8/1987 Peze et al.
4,699,209 A * 10/1987 Thorogood ..... 165/166
5,400,854 A * 3/1995 Iio et al. ..... 165/166
5,469,914 A 11/1995 Davison et al.
5,699,856 A * 12/1997 Merle ..... 165/166
6,016,865 A 1/2000 Blomgren
6,347,662 B1 * 2/2002 Davidian et al. ..... 165/166

* cited by examiner

*Primary Examiner*—Henry Bennett
*Assistant Examiner*—Terrell McKinnon
(74) *Attorney, Agent, or Firm*—Reising, Ethington, Barnes, Kisselle, Learman & McCulloch, PC

(57) ABSTRACT

The invention relates to an all-welded plate heat exchanger comprised of a plurality of plates welded together to form cassettes that are stacked one upon the other so as to provide primary and secondary alternating channels through which fluids are adapted to flow for exchanging heat. The primary channels provided within the cassettes connect at opposite ends with inlet and outlet openings. The cassettes are welded along two opposing sides via resistance seam welding. Baffle clips are fastened between the cassettes to partially close off the sides of the secondary channels provided between the cassettes. Two inlet headers, two outlet headers, a top cover member and a bottom cover member enclose the stacked cassettes.

19 Claims, 7 Drawing Sheets

ALL WELDED PLATE HEAT EXCHANGER

This invention is based on U.S. Provisional patent application Ser. No. 60/302,219 filed on Jun. 29, 2001 and relates to a plate heat exchanger for the purpose of exchanging heat between two fluids and the method of constructing such an exchanger.

BACKGROUND OF THE INVENTION

Heat exchangers developed up to the present time may generally be classified into two categories, namely tubular exchangers and plate exchangers. The conventional plate heat exchangers are manufactured by stacking a plurality of plates, configured in a way so that two fluids, one relatively hot and the other relatively cold, may be passed between alternating channels formed by the plates. Plate heat exchangers may be further broken down into two categories, namely gasket-containing heat exchangers and all-welded heat exchangers. Gasketed exchangers have many advantages over all welded exchangers, three of which being the accessibility of plates for cleaning, lower thermal stresses, and cost per area; however, distinct limitations are present. Gasket limitations occur with temperature, pressure, and compatibility with fluids used. To overcome these limitations, plate heat exchanger manufacturers have developed all welded plate heat exchangers. The major problem encountered with existing all welded units is the excessive thermal stresses present which leads to shorter equipment life. High manufacturing cost of separating the relatively hot and relatively cold fluid via common welding procedures and excessively thick heat transfer plates are other disadvantages.

U.S. Pat. No. 5,469,914, issued on Nov. 28, 1995, Roger C. Davidson and Achint P. Mathur discloses an all welded plate heat exchanger essentially formed by stacking elongated heat transfer plates having solid metal fillers along the two elongated sides, continuous TIG welding the fillers to the plates, and welding inlet and outlet headers for two or more fluids. The continuous welding of the two elongated sides results in higher manufacturing cost and difficulties in allowing for the differential thermal expansion of the plates. In addition, this method eliminates the possibility of repairing common weld failures.

U.S. Pat. No. 4,688,631, issued on Aug. 25, 1987, Andre Peze and Henry Fechner discloses a similar all welded plate heat exchanger essentially formed by welding pairs of plates containing multiple depressions thereby forming cassettes, via an electric seam welding method. The cassettes are then stacked while the extending flanges of the cassettes are bent ninety degrees and welded together, via an arc welding method, to seal off the secondary channels. The depressions are then spot welded to the adjacent plate for additional support. Inlet and outlet headers are then attached for two or more fluids. This solution improves the capacity of the exchanger to accommodate differential expansion; however, only slightly and at the expense of pressure containment. The need for relatively thick metal plates still appears to exist if substantial pressure ratings are to be obtained. In addition, repairs on the seam-welded cassettes do not appear feasible via this solution due to the continuous welding along the flange of the plates.

Neither of the above described heat exchangers, either individually or in combination, is seen to describe the present invention as claimed.

The objective of the present invention is to construct a plate heat exchanger, which more efficiently accommodates manufacturing cost, thermal expansion, and pressure containment than prior developed plate heat exchangers. This objective is achieved according to the present invention by replacing the continuous sealing of the two sides of a pair of adjoining rectangular cassettes, in which electric seam welding has been performed, with baffle clips and enclosing such clips in headers extending the length of the cassettes. The presence of the full length headers allows the baffle clips to be applied without welding or with only partial welding because the baffle clips are only acting in the capacity to prevent cross-flow and not fluid containment. This method of construction allows the internal pressure of the secondary fluid to be contained via the full length headers which when provided with an arcuate cross-sectional shape can contain moderately high pressures with relatively thin material. The baffle clips may be altered or removed to better facilitate the collection and distribution of fluids during condensation and or evaporation processes.

DETAILED DESCRIPTION OF THE INVENTION

Figure 1:
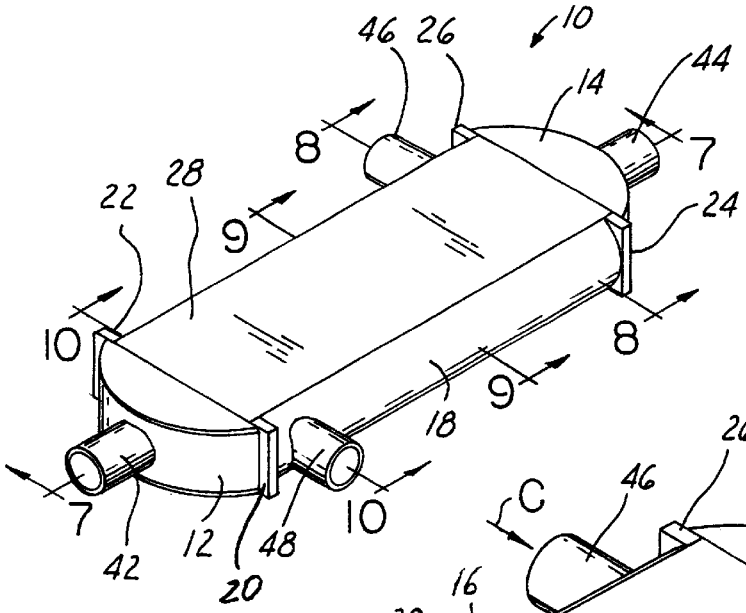
FIG. 1 is an isometric view of the preferred embodiment of the all welded plate heat exchanger according to the present invention.

Referring now to the drawings, the plate heat exchangers to be described are shown containing basically a rectangular core, although other shapes are possible. It is the intention of the drawings to show sufficient detail necessary for a full understanding of the invention and in no way limit the method in which the invention is embodied. Other forms of the invention such as multi-pass flows, drainable piping, manifolding multiple units together, and enclosing entire exchanger inside of a pressure vessel, will be obvious to persons skilled in the art.

Figure 2:
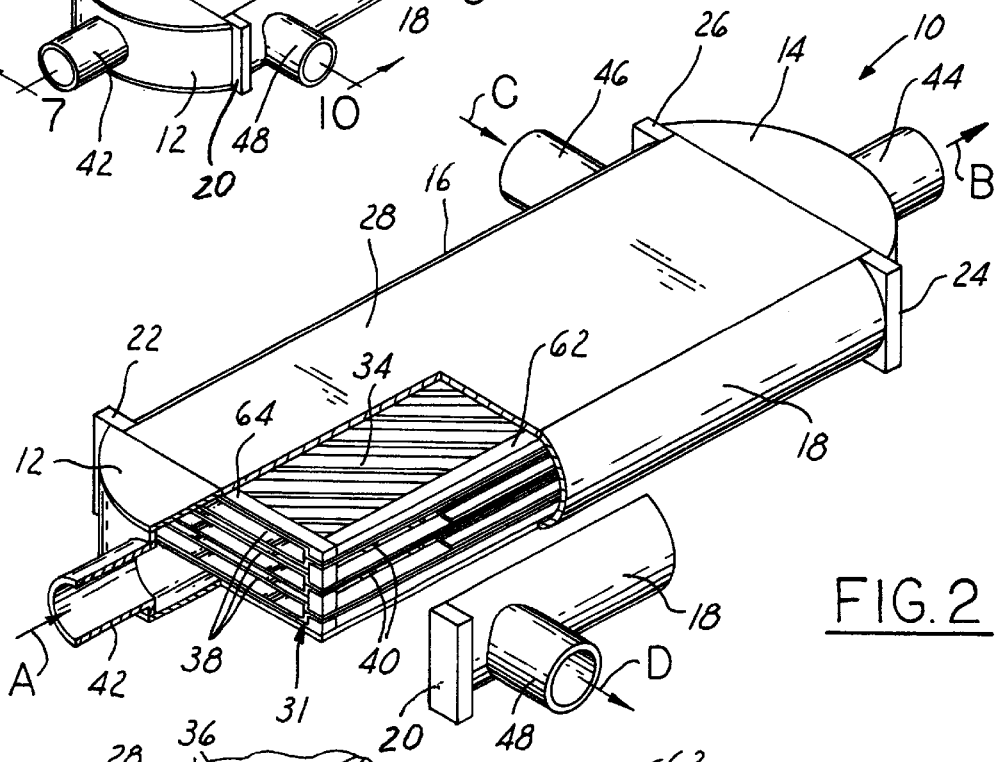
FIG. 2 is an isometric view of the preferred embodiment of the heat exchanger of FIG. 1 with some parts cut away to show part of the plate pack assembly provided within the interior of the unit.
Figure 2A:
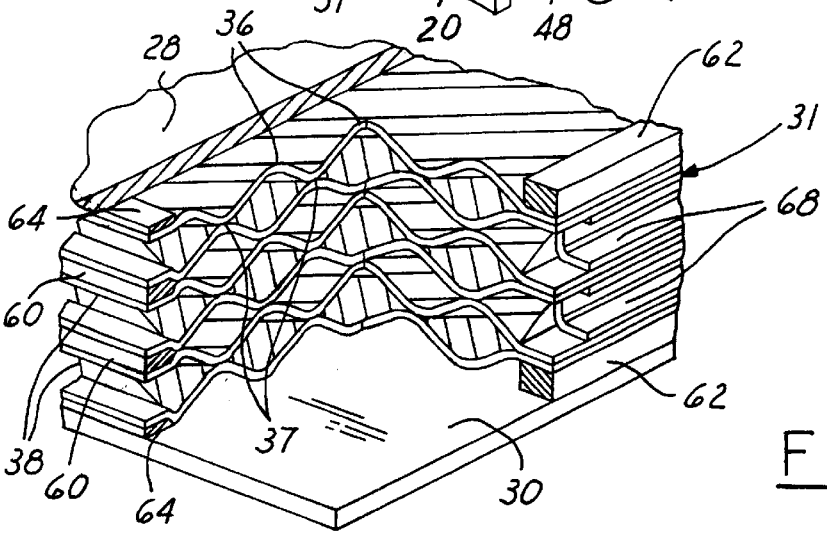
FIG. 2*a* is an enlarged isometric view of a cut-away of the corner of the plate pack assembly exposed in FIG. 2.
Figure 3:
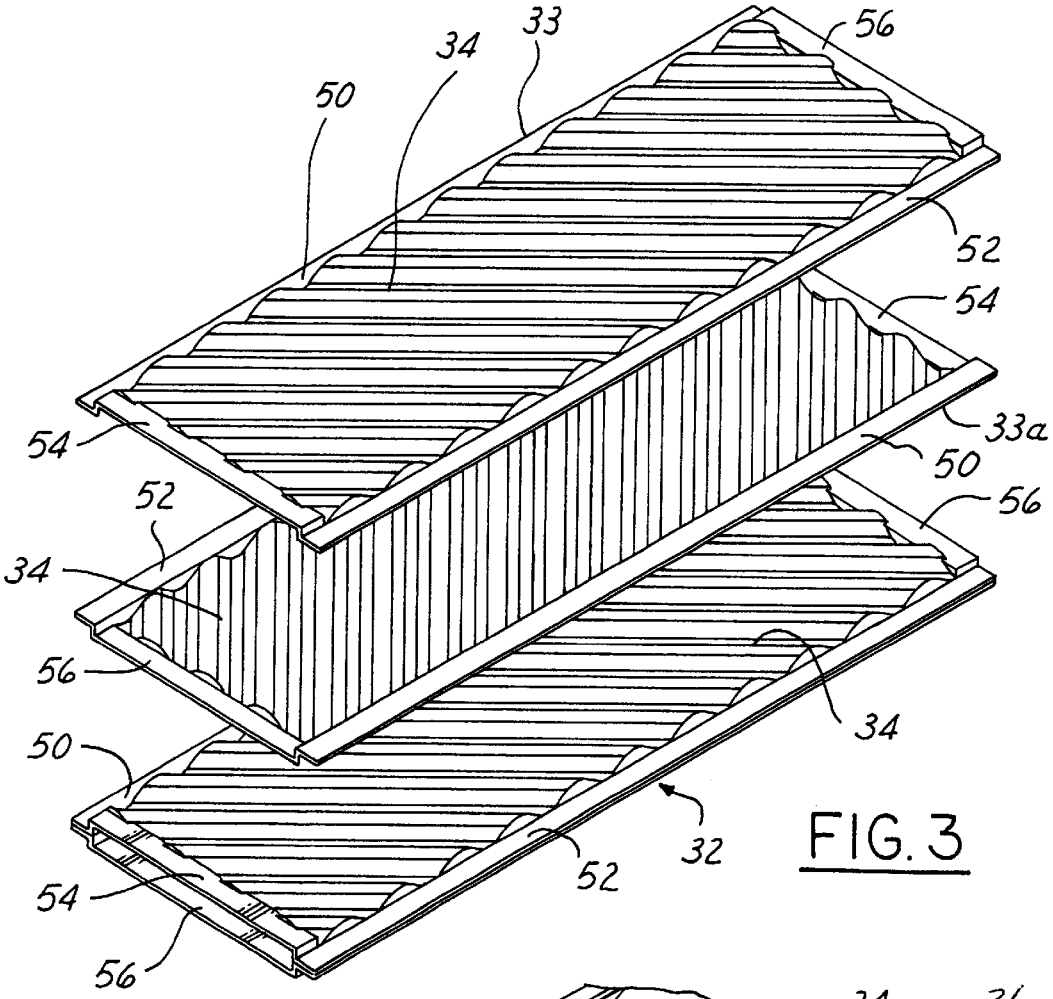
FIG. 3 shows two individual heat transfer plates and a resulting cassette following the seam welding on opposite sides heat transfer plates.

Referring now to the drawings and more particularly to FIGS. 1, 2 and 2*a* thereof, a heat exchanger 10, made according to the present invention, is shown with a cutaway view in FIGS. 2 and 2*a* so as to call attention to the unique method of construction of this invention. The heat exchanger 10 includes an outer housing consisting of a primary inlet header 12, a primary outlet header 14, a secondary inlet header 16, a secondary outlet header 18, four identical manifold flanges 20–26, a top cover member 28, and a bottom cover member 30. The headers 12–18, the flanges 20–26, and the cover members 28, 30 serve to enclose a plate pack assembly 31 seen in its entirety in FIGS. 2, 2*a* and 6. Located within the housing are three identical cassettes, each identified by reference numeral 32 that form a part of the plate pack assembly 31. As seen in FIG. 3 each cassette 32 is constructed from two identically formed rectangular heat transfer plates 33 and 33*a* the central body portion 34 of each of which is formed with a plurality of parallel and angled corrugations or depressions. In forming a cassette 32, one of the heat transfer plates 33, 33*a* is rotated 180 degrees and turned over so that one of the plates is superimposed upon the other. As seen in FIG. 2*a,* this causes the corrugations of each of the heat transfer plates 33, 33*a* to cross each other at a fixed angle and provide plurality of parallel and angled outer ridges 36 and inner ridges 37 for each of the heat transfer plates 33, 33*a*.

As seen in FIGS. 2 and 2*a,* the three cassettes 32 within the housing of the heat exchanger 10 provide three primary channels 38 for the flow of a primary fluid and two secondary channels 40 for the flow of a secondary fluid. The primary fluid enters the heat exchanger 10 in the direction shown by the arrow "A through a primary inlet nozzle 42 which is rigidly connected to an arcuately shaped inlet header 12. The primary fluid exits in the direction shown by the arrow "B" through a primary outlet nozzle 44 which is rigidly connected to the arcuately shaped outlet header 14. Accordingly, primary fluid entering the heat exchanger 10 via the primary inlet nozzle 42, flows through the primary channels 38, and exits the heat exchanger 10 through the primary outlet nozzle 44. The secondary fluid enters the heat exchanger 10 in the direction of the arrow "C" via the secondary inlet nozzle 46, flows through the secondary channels 40, and exits in the direction of the arrow "D" through the secondary outlet nozzle 48. As should be apparent, the inlet nozzle 46 and the nozzle 48 are rigidly connected to the secondary inlet header 16 and the secondary outlet header 18, respectively.

Figure 4:
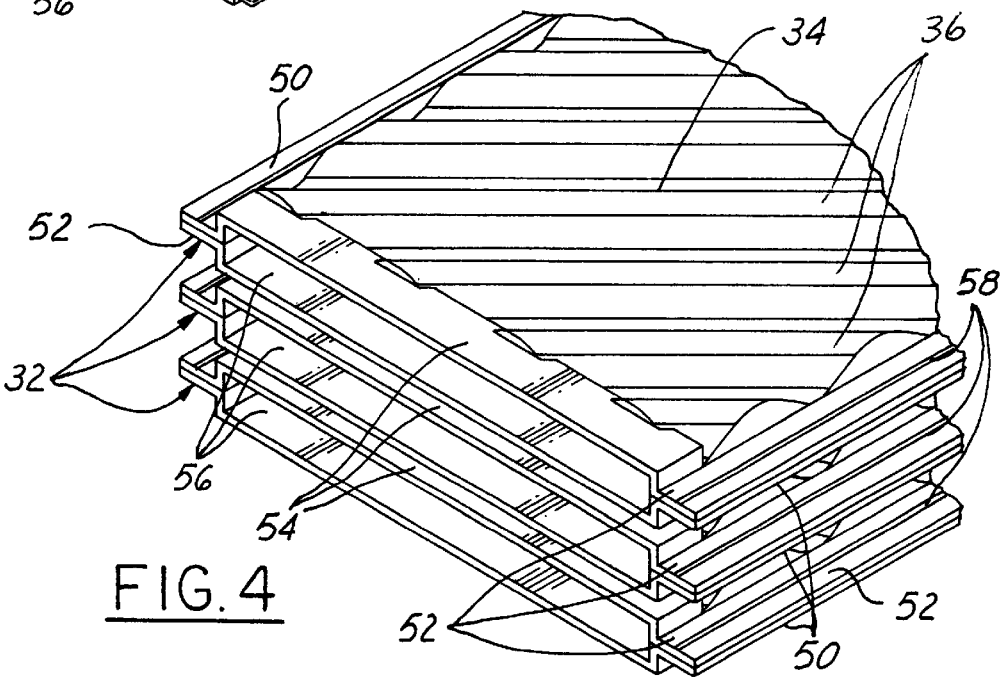
FIG. 4 shows one end of three stacked cassettes which are designed for the use with cassette shims.

More specifically and as seen in FIG. 3, each heat transfer plate 33, 33*a* is integrally formed with a pair of identical laterally spaced side flanges 50 and 52 located in a common plane. Also, the opposed ends of each heat transfer plate 33, 33*a* is integrally formed with identical end flanges 54 and 56 each of which is offset from side flanges 50 and 52. The end flanges 54 and 56 are also located in a common plane which is parallel to the plane of the side flanges 50 and 52. It will be noted that as seen in FIG. 4, the outer ridges 36 of the corrugations formed in each of the heat transfer plate 33, 33*a* are at a higher level than the plane of the end flanges 54 and 56. Thus, when each cassette 32 is formed by having one heat transfer plate rotated 180 degrees and inverted relative to the other heat transfer plate as mentioned hereinbefore, a rectangular opening is provided at each end of the cassette 32 by the end flanges 54 and 56. The opening defines the entrance area for the primary fluid which flows through the primary channel 38 of the cassette 32. As also seen in FIG. 4, after the heat transfer plate 33*a* is rotated, inverted, and positioned below heat transfer plate 33 with the side flanges 50, 52 in contact with each other, a continuous resistance seam weld 58 is provided along the length of each of the two connecting side flanges 50 and 52 so as to form the cassette 32 into a single separate unit.

It will be noted that the design of the heat transfer body portion 34 of the two heat transfer plates 33, 33*a* which form a cassette 32 is such that there is sufficient plate to plate contact points between the outer ridges 36 of adjacent cassettes 32, eliminating the need to spot weld adjacent cassettes for support. It will also be noted that FIG. 4 shows three prefabricated cassettes 32, in the stacked state prior to the insertion of rectangular cassette shims 60 for TIG weld reinforcement. When the cassettes 32 are placed on top of each other as shown in FIG. 4, the outer ridges 36 of the corrugations of adjacent cassettes 32 will be in contact with each other to provide a secondary channel 40 for the flow of the secondary fluid. Inasmuch as the outer ridges 36 of the corrugations are at a higher level than the end flanges 54 and 56 as mentioned above, a gap or space of uniform height and depth will be provided between the end flanges 54 and 56 of adjacent cassettes 32 when stacked as seen in FIG. 4. This gap or space is filled by use of the rectangular cassette shims 60 seen in FIGS. 2*a,* 5 and 7. The shims 60 assist in the arc welding of relatively thin metal plates and are thereby not necessary for all designs, as plate thickness may vary. In this case, the shims 60 are welded continuously along the end flanges 54 and 56 of adjacent cassettes 32 thus, in effect, interconnecting the stacked cassettes 32.

Figure 5:
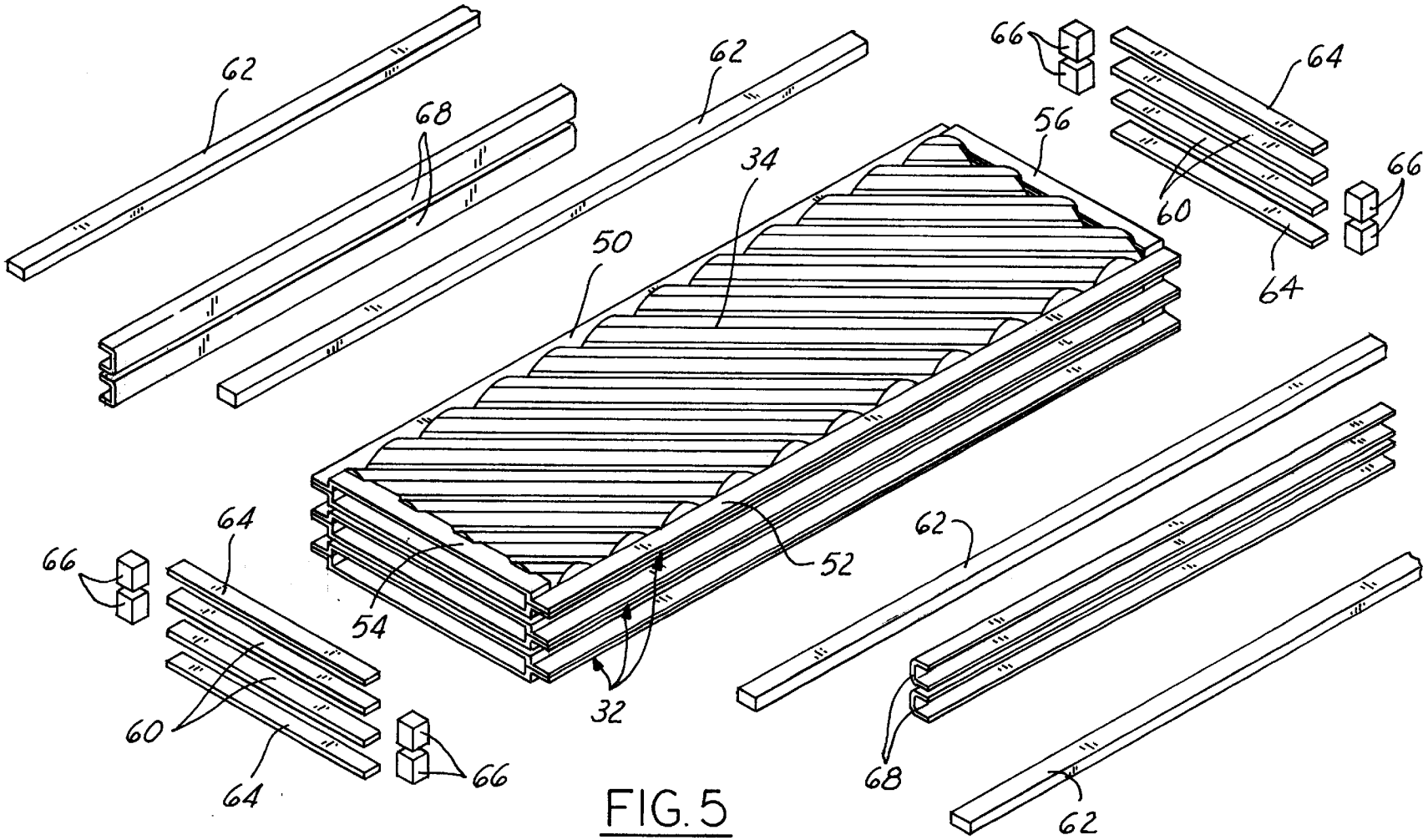
FIG. 5 is a partially exploded view of the plate pack assembly containing the cassette shims referred to above and other shims and bars which together with the cassettes form the plate pack assembly.
Figure 6:
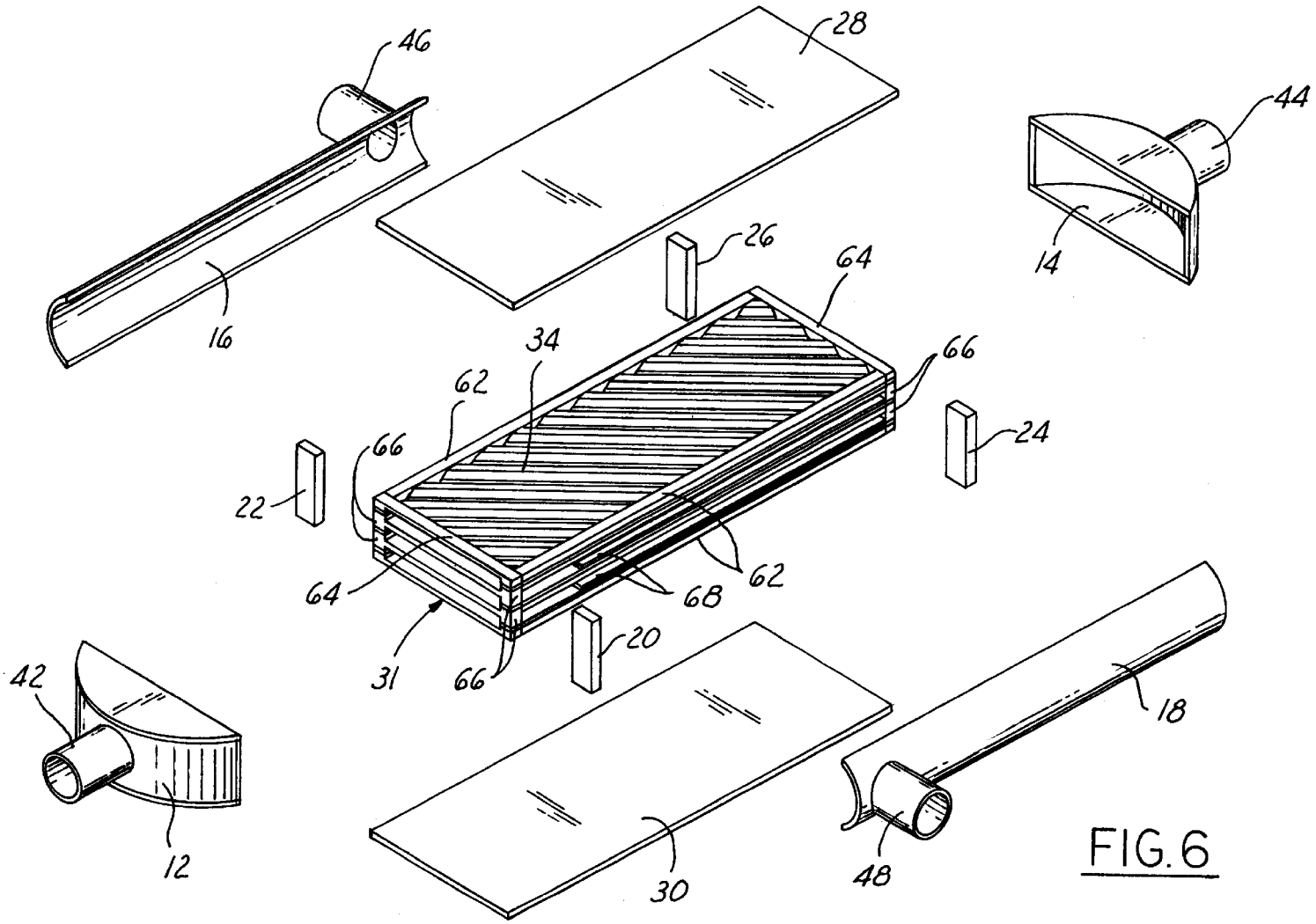
FIG. 6 shows an exploded view of the preferred embodiment of the heat exchanger with the plate pack assembly intact and the parts of the outer housing separated from each other.
Figure 7:
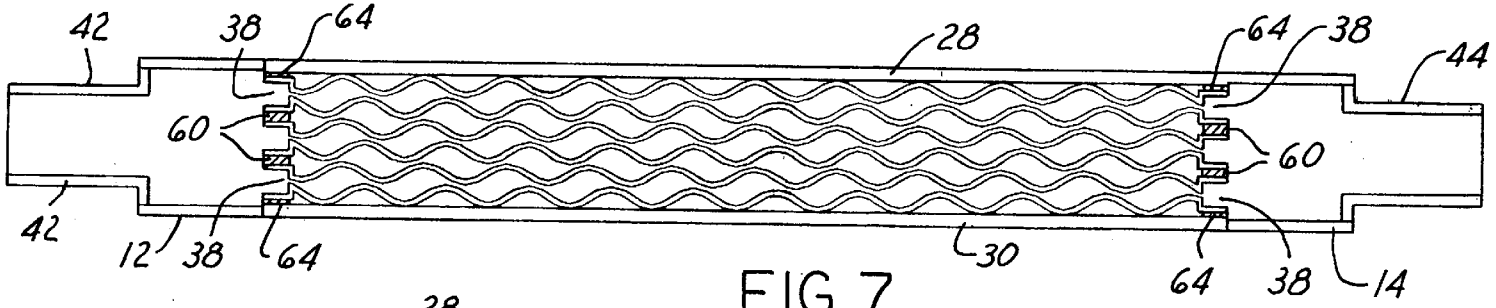
FIGS. 7,8, 9, and 10 are sectional views taken on line 7—7, line 8—8, line 9—9, and line 10—10, respectively, of FIG. 1.

The plate pack assembly or core 31 of the heat exchanger 10 when fully assembled can be seen in FIG. 5 and includes the four cassette shims 60 and eight cover plate shims. The cover plate shims consist of four identical side cover shims 62 and four identical end cover shims 64. The shims 62 and 64 essentially serve as a top and bottom support for each of the headers 12, 14, 16, and 18. The shims 62 are sized so as to fill the space along the length of each of the side flanges 50 and 52 of the cassettes 32 located at the top and bottom of the pack seen in FIGS. 6, and 8–10 so as to have the inner surface of each of the top cover member 28 and bottom cover member 30 in contact with the outer ridges 36 of the corrugations of the top and bottom cassettes 32. Similarly, the end cover shims 64 are sized so as to fill the recess created by having the end flanges 54 and 56 at a different level than outer ridges 36 of the corrugations in each heat transfer plate as mentioned above. Thus, as seen in FIG. 7, each end cover shim 64 is approximately one-half the thickness of the cassette shims 60 and has its upper planar surface in the same plane as the upper planar surface of the side cover shims 62. In addition and as best seen in FIGS. 5 and 6, eight generally cube-shaped and identical channel separating bars 66 are attached to the corners of the core of the heat exchanger 10 to fill the spaces between adjacent cassettes 32 existing at the corners of such cassettes 32. As best seen in FIG. 6, the exposed flat sides of the bars 66 lie in the same plane as the side edges and the end edges of the side cover shims 62. In the preferred form, the shims 62 and 64 are welded to the associated top and bottom cover members 28 and 30.

Figure 8:
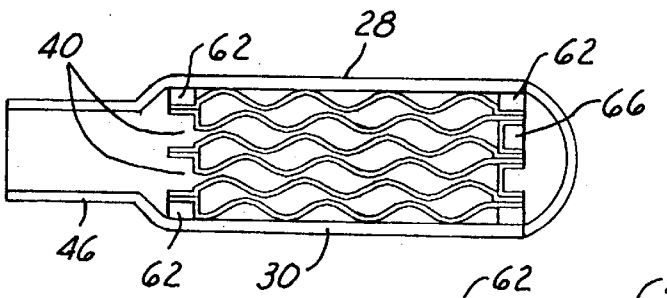
Figure 9:
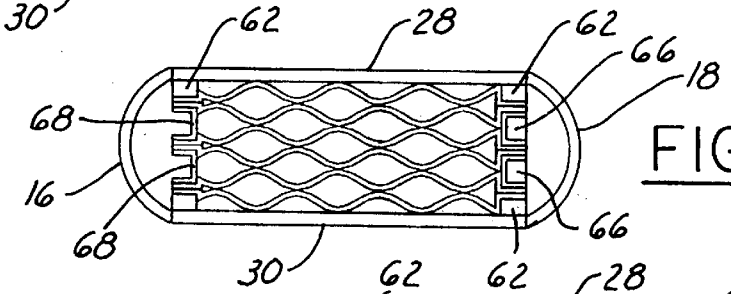
Figure 10:
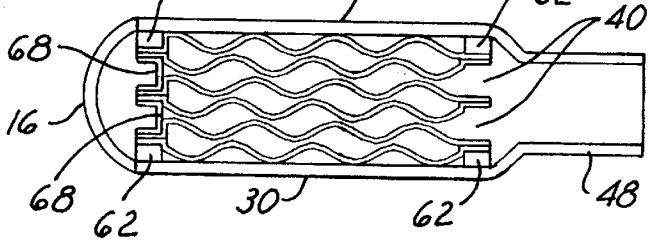

In addition, the plate pack assembly or core 31 of the heat exchanger 10 includes baffle clips 68 which are wedged in between the side flanges 50, 52 of the adjacent cassettes 32 and tack welded at a few points to the vertically spaced side flanges 50, 52 of adjacent cassettes 32. Each of the baffle clips 68 is generally U-shaped in cross section, as seen in FIGS. 8–10, and of equal length. The baffle clips 68 serve to partially block the secondary channels 40 along headers 16 and 18 and assure that the secondary fluid flows through the body portion of the cassettes 32 from the secondary inlet nozzle 46 to the secondary outlet nozzle 48 The baffle clips 68 are arranged such that the primary and secondary fluids flow in a countercurrent pattern; however, may be arranged to produce co-current or cross-flow flow patterns.

As seen in FIG. 6, the baffle clips 68, on one side of the pack assembly where the secondary outlet header 18 is located, start at the rear end of the cassettes 32 in contact with a bar 66 and end about three-quarters of the way towards the front of the cassettes 32 so as to allow for an exit for the secondary fluid as it flows through the secondary channels 40 into the secondary outlet header 18. On the other hand, the baffle clips 68 on the side of the plate pack assembly 31 where the secondary inlet header 16 is located, start at the front of the plate pack assembly 31 in contact with a bar 66 and end approximately three-quarters of the way towards the rear of the pack assembly allowing for the secondary fluid to flow from the header 16 to the secondary channels 40 and finally into the header 18 and exit through the secondary outlet nozzle 48.

As seen in FIG. 6, the top and bottom cover members 28 and 30 are generally the same rectangular shape as the heat transfer plates 33, 33*a*; however, they extend beyond the primary headers 12 and 14 and serve as the top and bottom portions of such headers. The manifold flanges 20–26 are welded to the plate pack assembly 31 to serve as both end-plugs and support for the secondary headers 16 and 18 which extend the entire length of the plate pack assembly 31. This arrangement, in conjunction with the baffle clips 68, allows the pressure inside the secondary channels 40 to be relatively equal to the pressure in the headers 16 and 18 and thereby eliminating the need to provide a continuous sealing weld between the baffle clips 68 and the side flanges 50 and 52 of the cassettes adjacent cassettes 32. The inlet and outlet headers 12 and 14 for the primary side are welded to the end portions of the top and bottom cover members 28 and 30, and to the upper and lower ends of the plate pack assembly 31. It will be noted that the seam welded cassettes 32 are not welded to each other by a continuous weld. Instead the baffle clips 68 are fastened to adjacent cassettes 32 by a few tack welds along the side flanges 50, 52. Since the cassettes 32 are not welded together to form the enclosure side wall of the heat exchanger 10, they are capable of expanding side ways and vertically at their side edges. This advantage is realized by having the secondary headers 16 and 18 have an arcuate cross sectional form as seen in of FIGS. 8–10 so as to allow for sideways expansion of the cassettes 32. In addition, at the rear ends of the baffle clips 68 along the header 18 and at the front end of the baffle clips 68 along the header 16, small bleed holes (not shown) can be provided in the vertical section of the baffle clip 68 to eliminate the dead re-circulation area that may occur in the two corners in the secondary channels 40.

Figure 11:
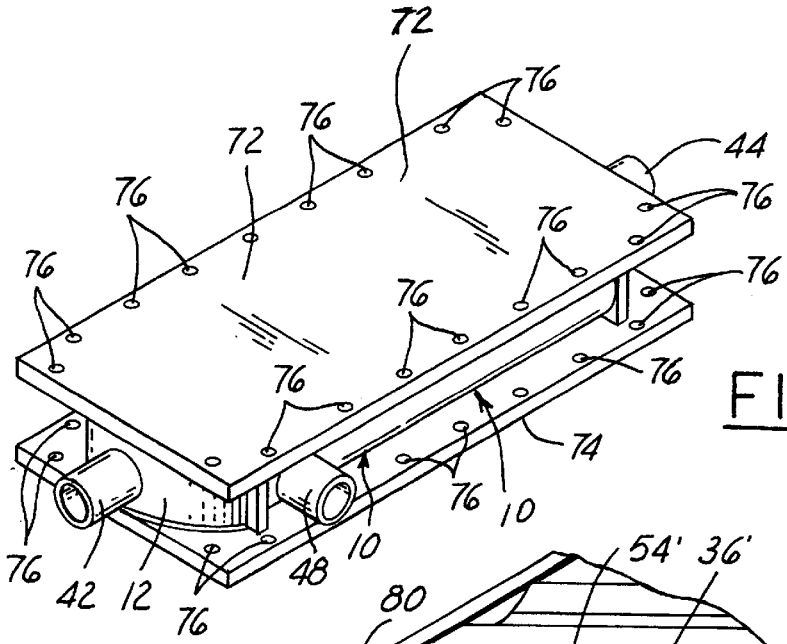
FIG. 11 is an isometric view of the heat exchanger seen in FIGS. 1–10 with carbon steel support members on the outside of the heat exchanger that are intended to be bolted together.

FIG. 11 is an isometric view of a modified version of the heat exchanger 10 of FIGS. 1–10. In this instance, the heat exchanger 10 is provided with rectangular carbon steel top and bottom plate-type support members 72 and 74 having a plurality of vertically aligned holes 76 adapted to receive bolts for interconnecting the plates 72 and 74. The pressure containing support members 72 and 74 vary in thickness as a function of internal pressure and the size of the secondary headers 16 and 18. Since these support members 72 and 74 do not come in contact with the hot and cold fluids, they are typically made from carbon steel to reduce the cost of a heat exchanger. The support members 72 and 74 are not needed in low-pressure applications.

Figure 12:
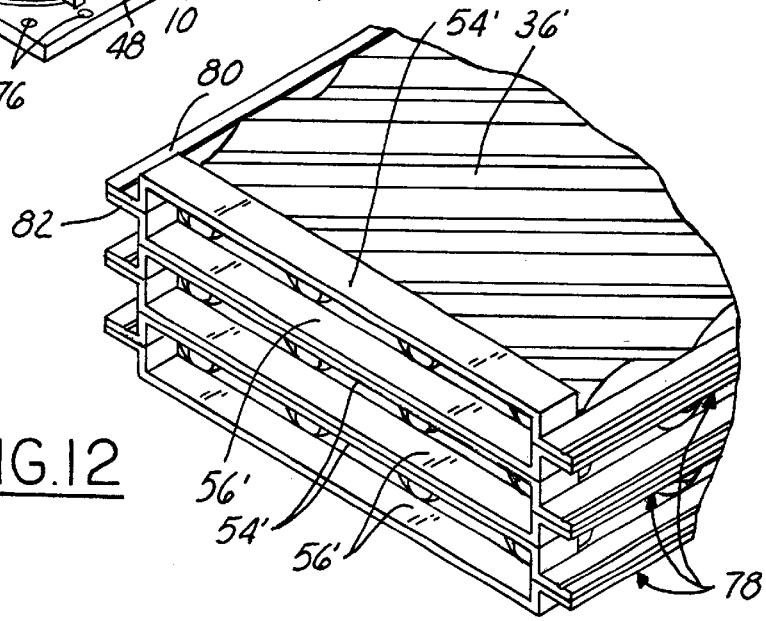
FIG. 12 is a view similar to that seen in FIG. 4 but shows a modified form of the plates designed for use without cassette shims.

FIG. 12 shows three identically modified cassettes (each identified by reference numeral 78) stacked without the use of the cassette shims 60 as provided in the plate pack assembly of the heat exchanger 10. Those parts of the cassette 78 that are identical to those of the cassette 32 are identified by the same reference numerals but primed. In this instance, the plates 80 and 82 of each of the cassette 78 have the outer ridges 36 of the corrugations in the body of each plate 80, 82 located at the same level as the end flanges 54' and 56'. In all other respects, the plates 80 and 82 are identical to the corresponding heat transfer plates 33, 33*a* of the heat exchanger 10. As mentioned above, the shims 60 are used to improve the arc weld when attaching front and rear ends of adjacent cassettes 32 that are formed of relatively thin metal. The plates 80 and 82 use thicker metal as shown in FIG. 12, thereby eliminating the need for the shims 60. It should be noted that the cassettes 78 could be substituted for the cassettes 32 in the heat exchanger 10 and could be used for providing a plate pack assembly such as that in the heat exchanger 10 except for the absence of the shims 60.

Figure 13:
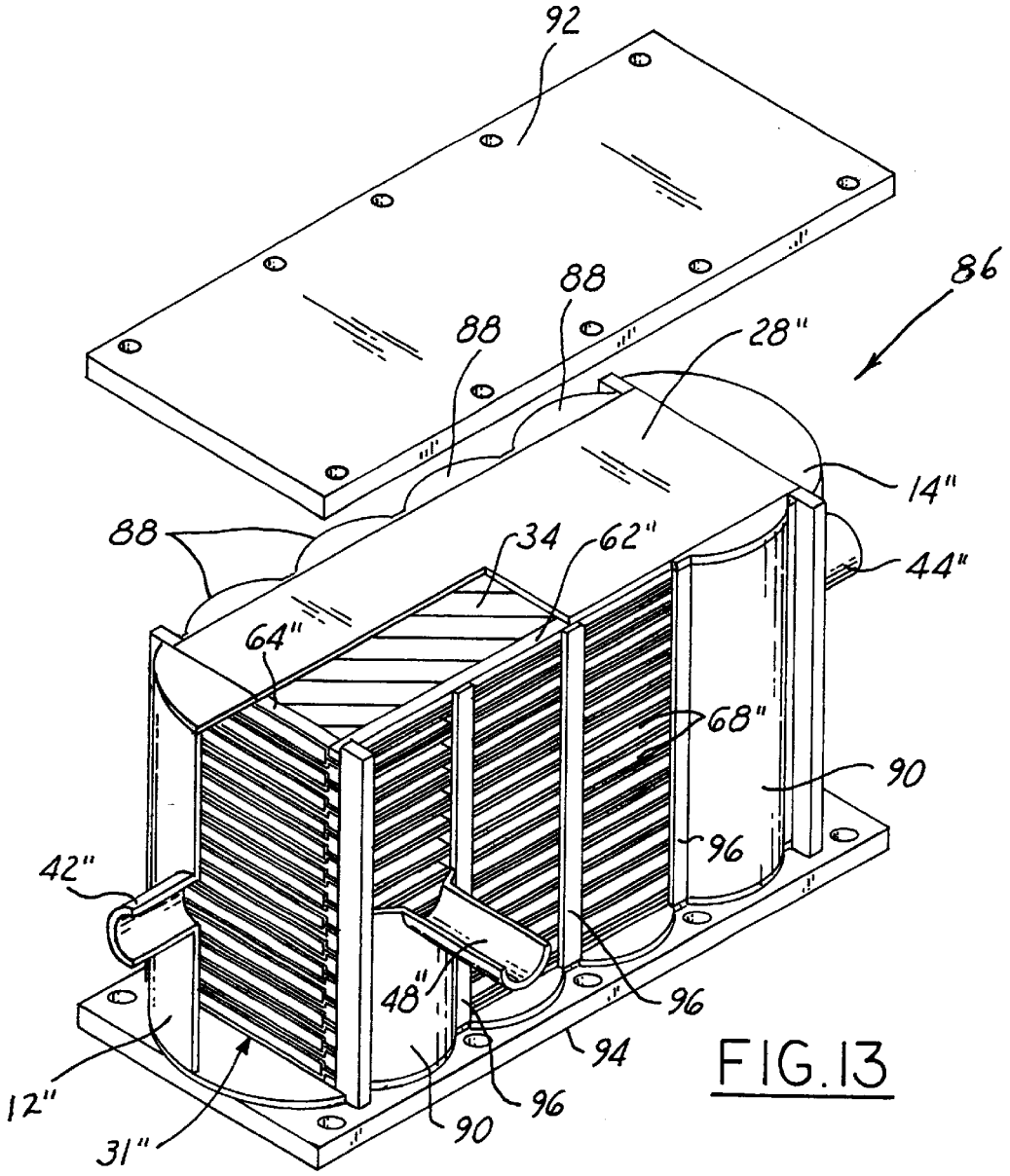
FIG. 13 is an isometric view of an alternate embodiment of the plate heat exchanger according to this invention.

FIG. 13 is an isometric view of an alternate embodiment of the plate heat exchanger 10 according to this invention. In this case, the heat exchanger 86 shown in FIG. 13 would be used when the number of heat transfer plates in a given unit are increased to a point where they exceed an amount that corresponds to the secondary headers increase in chord length, and to the extent of increasing the thickness of the support members to an unfavorable thickness, from an economic standpoint. It will be noted that parts of the plate pack assembly of the heat exchanger 86 is essentially the same in construction as that incorporated in the heat exchanger 10. For this reason, the parts of the plate pack assembly of the heat exchanger 86 that correspond to the parts of the plate pack assembly 31 of heat exchanger 10 are identified by the same reference numbers but double primed. It will also be noted that in this instance the modification of the heat exchanger 10 consists of replacing the horizontal secondary headers 16 and 18 with several identical vertical secondary inlet headers 88 on one other side of the plate pack assembly and equal number of vertical secondary outlet headers 90 on the other side of the plate pack assembly, thereby reducing the width of the top and bottom support members 92 and 94, respectively, which, in turn, reduces the thickness needed to contain a given pressure. Also, rather than having the baffle clips 68" fastened to the cassettes 32" as indicated with respect to the FIGS. 1–10 version of the heat exchanger, this alternate embodiment utilizes vertical support bars 96 secured to the top and bottom side shims 62" for maintaining the baffle clips 68" in position. In all other respects and as mentioned above, the core or plate pack assembly of this heat exchanger 86 is the same (except for the number of cassettes 32") as the core 31 of the heat exchanger 10.

Figure 14:
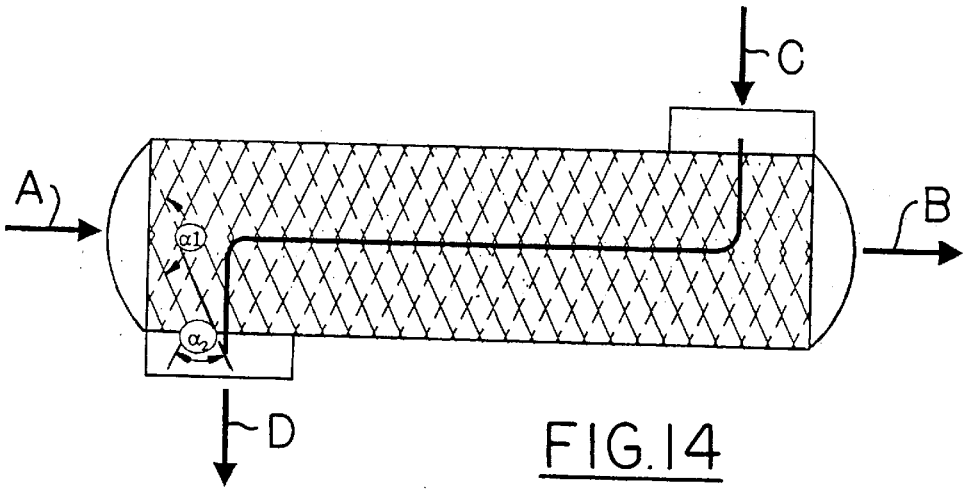
FIG. 14 is a top view of a corrugated high chevron angle plate and corresponding primary and secondary flow patterns.

FIG. 14 shows the respective primary and secondary flow patterns in a corrugated high chevron angle plate. The high chevron angle plates produce a relative low chevron angle for the secondary side entrance and exit portions, which results in the secondary side having a lower pressure drop relative to the primary side. A low chevron angle ($\alpha 2$) acts in a reverse manner, producing a higher chevron angle ($\alpha 1$) in the secondary entrance and exit portions. A chevron angle of forty-five degrees or a dimple pattern produces equal geometric or chevron patterns for both fluids. This flexibility allows the exchanger to be designed more efficiently by better accommodating unequal flows or unequal pressure drop limitations without resorting to an uneven number of passes, thereby resulting in lower surface area and lower cost of the unit.

Figure 15:
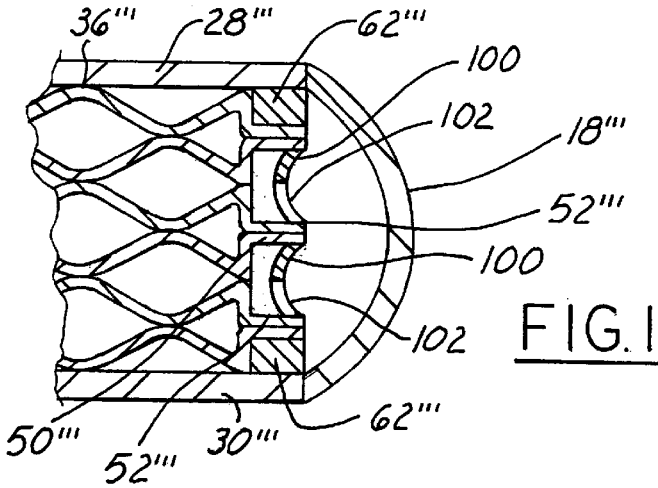
FIG. 15 is a cross-sectional view of alternate design of cassettes in which the baffle clips are formed integrally with the body of the heat transfer plates.

FIG. 15 is cross sectional view of alternate heat transfer plates adapted to form a cassette such as the cassette 32 in the heat exchanger 10. Note that those parts of such alternate heat transfer plates corresponding to the same parts of cassette 32 are identified by the same reference numerals but triple primed. As seen in FIG. 15, rather than having the baffle clips formed as separate U-shaped members such as the baffle clips 68 of heat exchanger 10, the side flanges 50''' and 52''' of the heat transfer plates are provided with vertically disposed dependent raised sections 100 and 102, respectively. Thus, when a pair of the heat transfer plates are interconnected as explained hereinbefore to form a cassette, ends of the sections 100 and 102 contacting each other are tack welded to form a baffle clip which functions in the same manner as the baffle clips 68 provided in the heat exchanger 10.

Various changes and modifications can be made to the construction described above without departing from the spirit of the invention. For example, rather than having corrugations or depressions of the type provided in the body of the heat transfer plates, other forms of depressions could be substituted for the corrugations, namely, dimples of the type shown in FIG. 2 of the aforementioned U.S. Pat. No. 5,469,914. Such change as well as other changes and modifications are contemplated by the inventors and they do not wish to be limited except by the scope of the appended claims.

We claim:

1. A heat exchanger comprising an outer housing and a plate pack assembly located within said housing, said housing including a top cover member and a bottom cover member, a primary inlet header and a primary outlet header each of which is connected to said top cover member and said bottom cover member and are located at opposed ends of said plate pack assembly, a plurality of secondary inlet headers and a plurality secondary outlet headers each of which is arcuate in cross section and extends vertically for connection to said top cover member and said bottom cover member, said secondary inlet headers being located at one side of said plate pack assembly and said secondary outlet headers being located on the opposite side of said plate pack assembly, said plate pack assembly comprising a plurality of generally rectangular cassettes stacked one over the other with a top cassette located adjacent said top cover member and a bottom cassette located adjacent said bottom cover member, each of said cassettes including a first heat transfer plate and a second heat transfer plate, said first and second heat transfer plates each being formed with a pair of laterally spaced side flanges and a pair of opposed end flanges, said end flanges being in a plane offset vertically from the plane of said side flanges, said first and second heat transfer plates being joined together by a continuous weld along said side flanges, said first heat transfer plate and said second heat transfer plate each having a body portion formed with depressions on opposite sides thereof that provide first and second fluid passages for fluid flow between the heat transfer plates of adjacent cassettes, said first fluid passages communicating with said primary inlet header and said primary outlet header and serving as passages for a primary fluid in alternate spaces of said stacked cassettes and said second fluid passages communicating with said secondary inlet header and said secondary outlet header and serving as passages for a secondary fluid in remaining spaces of said stacked cassettes, each of said alternate spaces for said primary fluid being provided by said pair of end flanges formed with each cassette at the opposed ends of said each cassette and each of said remaining spaces being provided by said side flanges of adjacent cassettes, shim means for filling said remaining spaces between the side flanges of the top cassette and the top cover plate and the flanges of the side flanges of the bottom cassette and the bottom cover plate, and baffle means located in said remaining spaces between said top cassette and said bottom cassette for directing said secondary fluid through said second fluid passages, said baffle means being maintained in position within said remaining spaces by vertical support bars secured to said top and bottom cover members along each side of said plate pack assembly.

2. The heat exchanger of claim 1 wherein said vertical support bars serve to interconnect said plurality of secondary headers to each other along each side of said plate pack assembly.

3. The heat exchanger of claim 1 wherein a pair of planar pressure containing support members are provided with a plurality of bolt holes adapted to receive bolts for interconnecting said support members, said support members consisting of a top support member in contact with said top cover member and a bottom support member in contact with said bottom cover member.

4. A heat exchanger comprising an outer housing and a plate pack assembly located within said housing, said housing including a top cover member and a bottom cover member, a primary inlet header and a primary outlet header each of which is connected to said top cover member and said bottom cover member and are located at opposed ends of said plate pack assembly, a secondary inlet header and a secondary outlet header each of which is connected to said top cover member and said bottom cover member and are located at opposed sides of said plate pack assembly, said plate pack assembly comprising a plurality of generally rectangular cassettes stacked one over the other with a top cassette located adjacent said top cover member and a bottom cassette located adjacent said bottom cover member, each of said cassettes including a first heat transfer plate and a second heat transfer plate, said first and second heat transfer plates each being formed with a pair of laterally spaced side flanges and a pair of opposed end flanges, said end flanges being in a plane offset vertically from the plane of said side flanges, said first and second heat transfer plates being joined together by a continuous weld along said side flanges, said first heat transfer plate and said second heat transfer plate each having a body portion formed with depressions on opposite sides thereof that provide first and second fluid passages for fluid flow between the heat transfer plates of adjacent cassettes, said first fluid passages communicating with said primary inlet header and said primary outlet header and serving as passages for a primary fluid in alternate spaces of said stacked cassettes and said second fluid passages communicating with said secondary inlet header and said secondary outlet header and serving as passages for a secondary fluid in remaining spaces of said stacked cassettes, each of said alternate spaces for said primary fluid being provided by said pair of end flanges formed with each cassette at the opposed ends of said each cassette and each of said remaining spaces being provided by said side flanges of adjacent cassettes, shim means for filling said remaining spaces between the side flanges of the top cassette and the top cover plate and the flanges of the side flanges of the bottom cassette and the bottom cover plate, and baffle means located in said remaining spaces between said top cassette and said bottom cassette for directing said secondary fluid through said second fluid passages.

5. The heat exchanger of claim 4 wherein a pair of planar pressure containing support members are provided with a plurality of bolt holes adapted to receive bolts for interconnecting said support members, said support members consisting of a top support member in contact with said top cover member and a bottom support member in contact with said bottom cover member.

6. A plate pack assembly for a heat exchanger having a top cover member and a bottom cover member, said plate pack assembly comprising a plurality of generally rectangular cassettes stacked one over the other with a top cassette located adjacent said top cover member and a bottom cassette located adjacent said bottom cover member, each of said cassettes including a first heat transfer plate and a second heat transfer plate joined together along a pair of laterally spaced side flanges, said first and second heat transfer plates each being formed with depressions on opposite sides of each of said heat transfer plates which provide first and second fluid passages for fluid flow between the heat transfer plates of adjacent cassettes, said first fluid passages serving as passages for a primary fluid in alternate spaces of said stacked cassettes and said second fluid passages serving as passages for a secondary fluid in remaining spaces of said stacked cassettes, each of said alternate spaces for said primary fluid being provided by a pair of spaced and parallel end flanges formed with each cassette at the opposed ends of said each cassette and each of said remaining spaces being provided by the side flanges of adjacent cassettes, shim means for filling said remaining spaces between the side flanges of the top cassette and the top cover plate and the flanges of the side flanges of the bottom cassette and the bottom cover plate, and baffle means located in said remaining spaces between said top cassette and said bottom cassette for directing said secondary fluid through said second fluid passages.

7. The plate pack assembly of claim 6 wherein additional shim means are provided between the end flanges of adjacent cassettes to assure that said primary fluid flows in said first fluid passages.

8. The plate pack assembly of claim 6 wherein generally cube shaped bars are provided at the corners of cassettes in horizontal alignment with said baffle means.

9. The plate pack assembly of claim 6 wherein said plate pack assembly is enclosed within a housing which includes said top cover member, said bottom cover member, a primary inlet header located at one end of said plate pack assembly, a primary outlet header located at the other end of said plate pack assembly, a secondary inlet header located at one side of said plate pack assembly, and a secondary outlet header located at the other side of said plate pack assembly.

10. The plate pack assembly of claim 6 wherein each of said secondary inlet header and said secondary outlet header is arcuate in cross section.

11. The plate pack assembly of claim 6 wherein each of said baffle means is tack welded to the side flanges of adjacent cassettes.

12. The plate pack assembly of claim 6 wherein each of said baffle means is U-shaped in cross section.

13. The plate pack assembly of claim 9 wherein said secondary inlet header and said secondary outlet header provide an arcuate chamber along each side of the plate pack assembly to allow for sidewise expansion of said cassettes.

14. The plate pack assembly of claim 11 wherein said baffle means extend partially along each side of said cassettes so as to provide an inlet for said secondary fluid at adjacent one end and long one side of said plate pack assembly and to provide an outlet for said secondary fluid adjacent the opposed end and along the other side of said plate pack assembly.

15. The plate pack assembly of claim 6 wherein the depressions are formed in the body portion of each of said heat transfer plates and are surrounded by said end flanges and said side flanges.

16. The plate pack assembly of claim 15 wherein said depressions consist of parallel and angled corrugations formed in said body portion of each of said heat transfer plates.

17. The plate pack assembly of claim 6 wherein said end flanges of each heat transfer plate are located in a plane positioned at a higher level than the plane passing through said side flanges.

18. The plate pack assembly of claim 16 wherein the outer ridge of said corrugations is at a level higher than the top surface of said end flanges.

19. A plate pack assembly or claim 6 wherein said baffle means are integrally formed with said side flanges.

* * * * *